United States Patent [19]

Haidt et al.

[11] 4,432,477

[45] Feb. 21, 1984

[54] CARRIER FOR MUSIC PLAYER

[76] Inventors: Jonathan D. Haidt; Elaine Haidt, both of 35 Church La., Scarsdale, N.Y. 10583

[21] Appl. No.: 421,339

[22] Filed: Sep. 22, 1982

[51] Int. Cl.[3] ..... A45C 11/00

[52] U.S. Cl. ..... 224/222; D2/383; 224/267; 224/901

[58] Field of Search ..... 224/222, 219, 901, 223, 224/224, 229, 267; D2/402, 383, 229; D3/56, 58, 60; 2/170, 311, 312, 317, 318

[56] References Cited

U.S. PATENT DOCUMENTS

D. 258,246 2/1981 Kravchenko ..... D2/383

3,372,438 3/1968 Rinecker ..... 224/901 X 4,135,653 1/1979 Sieloff ..... 224/222

4,330,073 5/1982 Clark ..... 224/223

*Primary Examiner*—Steven M. Pollard

*Assistant Examiner*—David Voorhees

*Attorney, Agent, or Firm*—Brooks, Haidt, Haffner & Delahunty

[57] ABSTRACT

An adjustable band fits around a wearer's upper arm for carrying, in a pocket of the band, a musical tape player, radio or the like, which cannot otherwise conveniently be worn or carried. An object in the pocket is protected during outdoor use. Additional pockets can be provided.

12 Claims, 5 Drawing Figures

Fig. 1.
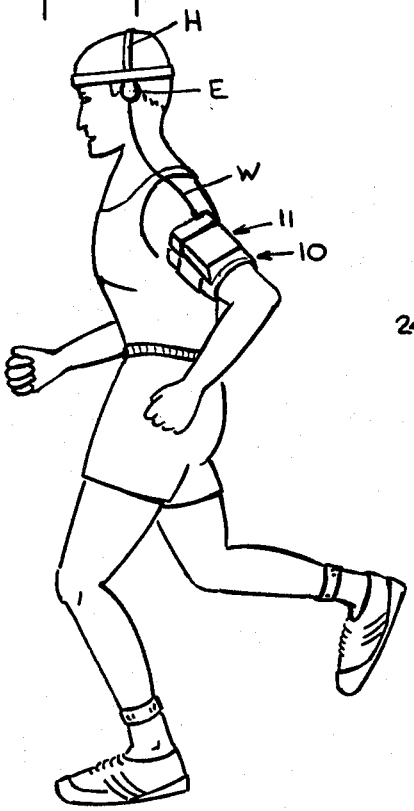
Fig. 4.
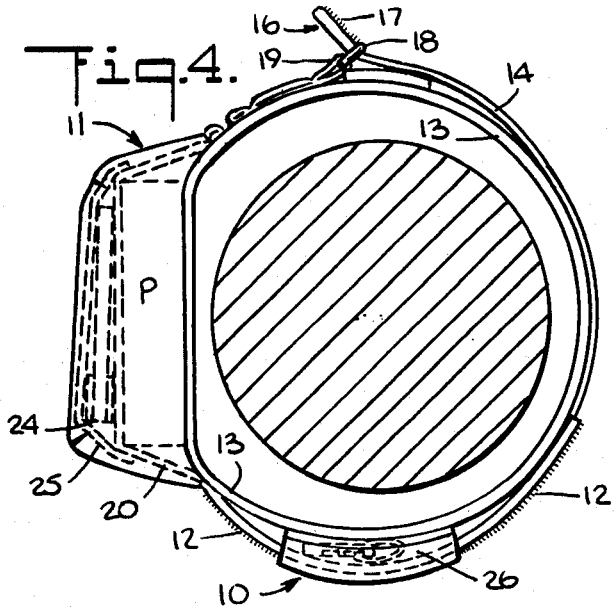
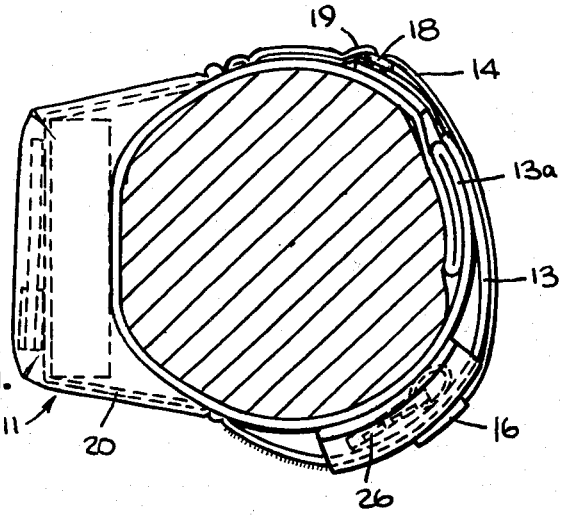
Fig. 5.
Fig. 2.
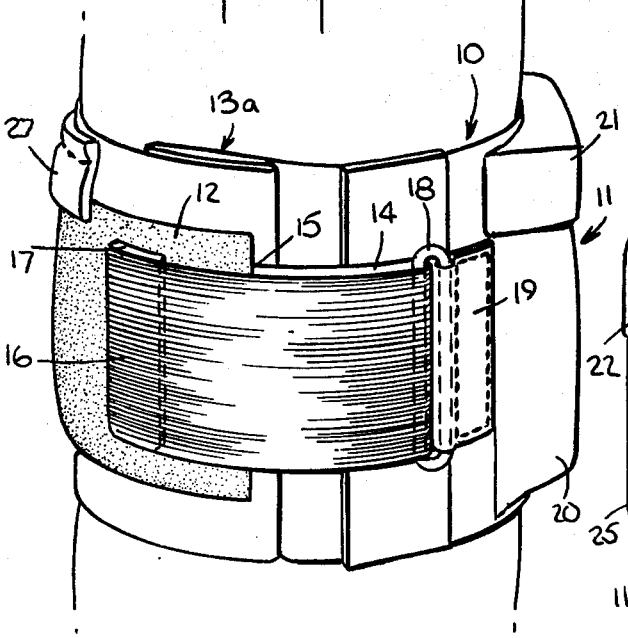
Fig. 3.
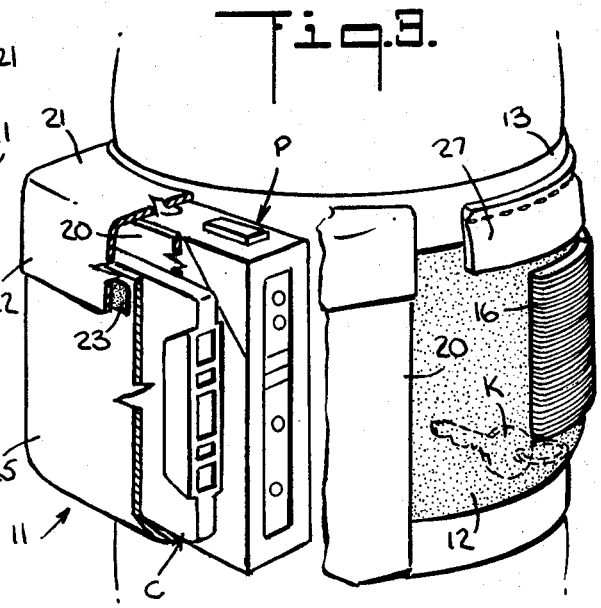

CARRIER FOR MUSIC PLAYER

BACKGROUND OF THE INVENTION

1. Field of the Invention

The invention relates to an adjustable armband, and more particularly to a band with one or more pockets which is wearable about the upper arm to carry a tape player, radio or the like.

2. Discussion of the Prior Art

Small players equipped with lightweight headphones popularly used to listen to radio broadcasts and music tapes have not been comfortable or easy to carry for runners and others engaged in sports activities.

Carrying straps worn around the neck let the player swing back and forth against the wearer's chest. Although players can be attached to a belt, many runners and sports participants do not wear belts, or find belt attachments cumbersome. If a tape player is held in a runner's hand, the torque on the mechanism as the arm swings causes distortion of the sound.

There is a need for a convenient and comfortable carrier for a radio or tape player during vigorous activities.

SUMMARY OF THE INVENTION

A continuous annular band of fabric, large enough in circumference to be easily placed around any wearer's upper arm, has a pocket in which a player can be carried. As used throughout this application, the term "player" refers to a magnetic tape player and/or portable radio receiver. It will be understood that other objects can be carried in the pocket of the band, but the most common use presently envisaged is the carrying of a player by a person who is running or enjoying some other physical activity while listening to music.

The width of the band is preferably somewhat greater than the height of the player to be carried. A pocket on the outer side of the band is sized to receive the player. The band has a belt fastener. After sliding the band over the hand and up to the upper arm, the user tightens the band to fit snugly in place by pulling the belt through a loop, causing the band to fold back upon itself. The belt is then fastened.

The presently preferred fastening means is hook and loop material such as that distributed under the trademark Velcro, one strip at the end of the belt fastener and one on the outside of the band. This makes tightening and securing the band by using only one hand easy. Other kinds of fasteners, such as buttons, hooks and eyes, etc. are more difficult to secure onehanded, and do not afford such great adjustability as the hook and loop material arrangement. A cover in the form of a flap to close the top of the pocket can also be held closed by hook and loop material.

The cover for the pocket leaves room at the sides for the cable from the player to the user's headphones. If desired, a hole or holes provided on the pocket cover, or at the side of the pocket, will allow manipulation of the controls of a player. Since most users will not frequently change the control settings, holes for the player controls will probably not be provided, so the player can be fully enclosed and better protected from rain, sand, dust, etc.

Besides the pocket for the player, the band can have other pockets, to carry, for example, the user's keys, an extra tape cassette, or a credit card. One preferred location for such an extra, smaller pocket, is on the outside of the pocket which holds the player, so that the extra pocket can be closed by the same flap which covers the pocket holding the player.

When the band is in use the player is held in place by pressure against the wearer's arm through the inner side of the pocket, so even if the player is considerably smaller then the pocket, it will stay in place.

The band should be of some material which, while not elastic, will stretch or "give". Denim or various synthetic fabrics are suitable. In some cases it is desirable to provide the band with an inner lining for comfort in wearing the band around a bare arm. The inner lining should be of some material which feels comfortable against the wearer's skin. In any case the band circumference should be great enough so that it can be worn over a shirt, and adjustable down to the circumference of a small arm for use, for example, by children. One standard size can be made to fit all potential users.

The band can be made reflective for use in twilight or darkness, either by fabricating it of some material treated to reflect, or by securing a strip or strips of reflective material to the band.

Preferably the band, or at least the pocket for the player, is water resistant for protection of the player.

These and other features and advantages of the carrier of the invention will be more fully understood when the following detailed description of a preferred embodiment is read, particularly when taken in conjunction with the accompanying drawing figures, in which like reference characters designate like parts throughout.

BRIEF DESCRIPTION OF THE DRAWINGS

FIG. 1 illustrates the use of the carrier by a runner.

FIG. 2 is a view in perspective of the carrier secured about a wearer's arm, and showing the presently preferred form of belt fastener.

FIG. 3 is a perspective view, with parts cut away to show how contents are carried in the carrier's pockets, and with dashed lines showing internal elements.

FIG. 4 is a view from above, showing the carrier in loose (untightened) condition, as when it is being put on or removed.

FIG. 5 is a view similar to that of FIG. 4, but with the belt tightened and secured.

DETAILED DESCRIPTION OF A PREFERRED EMBODIMENT

The runner shown in FIG. 1 can comfortably and conveniently listen to a player carried by means of the armband, generally designated by reference numeral 10. As illustrated, the arm band 10 has a pocket 11 in which the player is snugly fitted during use. A headset H has earphones E connected to the player by wire W. It will be seen that carrying a player in this manner does not interfere with the wearer's freedom of movement, and does not subject the player to violent motion, since the upper arm does not move as far or fast as, say, the runner's wrist or hand.

A runner is shown for purposes of illustration only, since the carrier of the invention can be advantageously used to listen to a player while performing any of many physical activities, such as fishing, rowing, hiking, skating, etc.

FIG. 2 shows the presently preferred means of adjusting and fastening the band 10 about a wearer's arm. A patch 12 of hook and loop material such as that distributed under the trademark Velcro is secured to the outside of an annular strip 13 of flexible fabric which constitutes the body of the armband. A belt or strap 14, narrower than the band body 13, has one belt end 15 secured, as by sewing, to the body 13 of the armband 10 at or near the location of the hook and loop material patch 12.

The other end 16 of the belt 14 is provided with an endpiece 17 of hook and loop material which is engageable with the material of the patch 12. The belt end 16 is preferably of doubled thickness, as shown. Preferably belt end 16 is of sufficient thickness or width as to resist slipping through loop 18.

FIG. 2 shows the carrier 10 in secured condition. The fastener belt 14 runs through a flat loop 18 carried by a fabric flap 19 which flap is attached to the body 13 of the band 10. Pulling the belt 14 through the loop 18 causes the body 13 of the band to fold back upon itself, as shown at 13*a* until the band 10 is snugly but comfortably tight about the wearer's arm. When the band 10 has been comfortably adjustably adjusted, the wearer secures the hook and loop material 17 at the end of the belt 16 to the hook and loop material patch 12 by pressing the end 16 against the patch 12.

The partially cut-away view of FIG. 3, shows a player P, illustrated as a cassette tape player, fitted in the pocket 11. The pocket 11 preferably has a flexible, integral wall 20, secured, as by sewing to the body 13 of the carrier, and preferably formed of the same fabric as the body 13. A cover flap 21 serves to close the pocket 11. In the presently preferred embodiment of the invention the cover flap is provided, at its free edge 22, with a strip of hook and loop material for attachment to a mating hook and loop material strip 23 on or near the upper outside edge of the pocket 11, as best seen in FIG. 3.

In the embodiment illustrated in FIGS. 3, 4 and 5, the pocket 11, which carries the player, has an auxilliary, smaller pocket 24, provided outside the pocket 11 by simply attaching a further generally rectangular piece of fabric 25 at three of its edges to the wall 20 of the pocket 11, as shown in FIG. 4. In this case, the auxilliary pocket 24, shown holding an extra tape cassette C, can be closed by the same cover flap 21 which closes the main pocket 11. Accordingly the hook and loop material strip 23 is shown mounted at the upper outside edge of the patch 25. If the pocket 24 is omitted, the strip 23 would be mounted on the wall 20 of the pocket 11.

Of course some other type of fastener can be used in place of the means shown for securing the cover flap 21. In some cases, fastening means can be omitted from the cover flap 21, since there is no danger of the pocket contents falling out of the pocket when the carrier 10 is in use.

An additional small pocket 26 can be provided within the patch 12 of hook and loop material to which the end of belt 14 is secured, by attaching the patch 12 to the body 13 of the band only at the side and bottom edges of the patch 12. FIGS. 3–5 show such an additional pocket 26 as used to carry a key K. If desired the pocket 26 can be held closed by yet another strip 27 of hook and loop material secured to the body 13 of the band 10 above the patch 12 as best seen in FIGS. 2 and 3. It will be noted that the closure strip 27 is not long enough to interfere with the end 16 of the belt 14 (See especially in FIG. 3).

Reverting to FIG. 4, showing the carrier band 10 in loose, unfastened condition, it will be seen that the flat inner side of the player P causes the body 13 of the band to lie flat against the back of the player. Thus, when the belt 14 is pulled to the tightened position of FIG. 5, tension is applied against the front and rear of the player P by the wearer's arm through the band body 13, and by the wall 20 of the pocket 11. This desired effect is among the reasons why fabric having some stretch or "give" is a preferred basic material for the carrier 10.

Generally speaking fabric parts can be attached to other fabric parts by sewing, and the several pieces of hook and loop material can be sewed on. In the presently preferred embodiment shown, the only non-fabric element of the carrier 10 is the loop 18 through which the belt 14 passes. The loop 18 is preferably of metal, but could be of hard plastics material.

Snap fasteners could be employed to replace one or more of the hook and loop material fasteners shown, but snaps are somewhat more difficult to manipulate with one hand. Conventional hook and eye fasteners, buttons, zippers or the like are also more difficult to open and close than the hook and loop material fasteners shown.

As previously noted, because of the tension on the fabric parts of the carrier 10 when fastened in place, objects in the pocket or pockets are very unlikely to become dislodged. Thus, one or more of the pocket cover flaps can be omitted. However, when the carrier 10 is removed from the user's arm, the fabric is not under tension, and an object might fall out of a pocket, so the presently preferred embodiment provides for securing the pockets closed.

The hook and loop means for adjustably securing the belt fastener 14, can, if desired, be replaced by a buckle of the type having teeth for engaging and holding a belt under tension, but such a buckle is more difficult to loosen when pulled tight than the hook and loop fasteners shown.

The pocket 11 need not be covered completely by a cover flap like the flap 21. In fact, some opening is left for the passage of the wire W. If the top of a player P or other object in the pocket does not require protection such as that afforded by a flap like the flap 21 shown, a narrower strip (not illustrated) consisting of, or provided at its end with hook and loop material can be substituted for the flap 21. Such a modified fastener arrangement can permit access to controls at the top of a player while wearing the carrier 10 and without opening the pocket 11.

Similarly, the bottom of pocket 11 need not be fully closed, but could have a narrow strip running from the body 13 of the belt to a pocket wall at the bottom of the pocket which would suffice to support a player or other object therein.

If carrier bands 10 according to the invention are manufactured for use with a particular model of player in mind, apertures for easy access to player controls can be readily provided at the points where such controls will be when a player is in place in the pocket 11.

Although a particular embodiment which is presently preferred and certain modifications thereof have been described in detail, various other applications, choices of materials, modifications and the like, will suggest themselves to those acquainted with the art, and are considered to be within the spirit and scope of the invention.

What is claimed is:

1. An armband carrier for a music player or the like comprising a continuous annular flexible carrier body for encircling a wearer's upper arm, a pocket sized to hold a player, belt means permanently attached at one end of said carrier body and means associated with said belt means for applying tension to the belt means for adjusting the armband to secure the armband in place on a wearer's arm, wherein said means associated with the belt means for applying tension comprises a loop for passage of the belt means through said loop and means in said carrier body for securing in place an end of said belt means which is not permanently attached to said carrier body.

2. An armband carrier for a music player or the like as defined in claim 1 wherein said belt means is narrower than said carrier body and the end portion of said belt means passed through said loop is thicker than the remaining portion of said belt means.

3. The armband carrier of claim 1 and including means for closing said pocket.

4. The armband carrier of claim 3 wherein the means for closing said pocket comprises a flap and fastening means on the flap.

5. The armband carrier of claim 4 including one or more additional pockets.

6. An armband carrier for a music player or the like comprising a continouous annular band of fabric sufficiently flexible to fold back upon itself, said band being of sufficient circumference to encircle a wearer's upper arm; belt fastener means including a flexible belt permanently secured at one end to said continuous band, said belt having a fastener at an end remote from the end which is permanently attached to said band, a loop secured to said band for passage of said remote end of the belt through said loop, and a second fastener on said band positioned for attachment of said first fastener to said second fastener when said remote belt end has been passed through said loop and folded back over the end of said belt which is permanently secured to said band for adjustment of the band to fit snugly about a wearer's arm; and a pocket on said band sized to receive and carry a music player.

7. The armband carrier of claim 6 wherein said first and second fasteners comprise hook and loop material.

8. The armband of claim 6 and including at least one additional pocket on the band.

9. The armband of claim 8 and including means for closing at least one of said pockets.

10. The armband of claim 9 wherein said means for closing at least one pocket comprises a single flap closing two pockets.

11. The armband of claim 10 including hook and loop material fastener means for securing said flap closed.

12. An armband carrier for a music player or the like as defined in claim 6 wherein said belt means is narrower than said carrier body and the end portion of said remote end of said belt is thicker than the remaining portion of said belt means.

* * * * *